US005396321A

United States Patent [19]

McFarland et al.

[11] Patent Number: 5,396,321

[45] Date of Patent: Mar. 7, 1995

[54] COMPILED SET TRANSFER DEVICE

[75] Inventors: Freddie McFarland, Rochester; Michael W. Traxler, Rush; Paul N. Richards, Fairport; Kenneth B. Mahon, Rochester, all of N.Y.

[73] Assignee: Xerox Corporation, Stamford, Conn.

[21] Appl. No.: 50,792

[22] Filed: Apr. 22, 1993

[51] Int. Cl.[6] ..... G03G 21/00

[52] U.S. Cl. ..... 355/313; 414/789.9

[58] Field of Search ..... 355/308, 309, 322, 324, 355/313, 314; 271/213; 270/53, 52, 58; 413/789.9

[56] References Cited

U.S. PATENT DOCUMENTS

| | | | |
|---|---|---|---|
| 4,358,197 | 11/1982 | Kukucka et al. . | |
| 4,417,801 | 11/1983 | Eisemann . | |
| 4,444,491 | 4/1984 | Rinehart et al. . | |
| 4,479,641 | 10/1984 | Bean et al. | 355/324 X |
| 4,586,640 | 5/1986 | Smith | 227/14 |
| 4,586,640 | 5/1986 | Smith | 355/324 X |
| 4,871,158 | 10/1989 | May et al. | 270/53 |
| 4,905,054 | 2/1990 | Rood | 355/324 |
| 4,926,220 | 5/1990 | Matysek et al. | 355/313 |
| 4,926,220 | 5/1990 | Matysek et al. | 355/313 |
| 5,018,717 | 5/1991 | Sadwick et al. | 271/207 |
| 5,174,556 | 12/1992 | Taylor et al. | 270/58 X |

FOREIGN PATENT DOCUMENTS

| | | | |
|---|---|---|---|
| 0559553 | 9/1993 | France | 271/213 |

*Primary Examiner*—A. T. Grimley
*Assistant Examiner*—Shuk Y. Lee
*Attorney, Agent, or Firm*—Kevin R. Kepner

[57] ABSTRACT

A multi-mode apparatus for ejecting individual sets of compiled, attached or unattached sheets to substantially the same location for any size sheet from a electrophotographic printing machine to an off line finishing device without impairing the process speed thereof. In a first mode each sheet set is compiled on a moveable member. The moveable member is then translated by actuating a pneumatic cylinder to translate the compiled sheet set to a location external of the compiling apparatus. A vertically moveable bail device applied a normal force to the sheet set to maintain the integrity of the set during transport but is substantially frictionless so as to not disturb the registration of the sheet set. The translating member is able to quickly transport a compiled set of sheets from a location internal of the compiling device to an external location whereat the sheet set may be fed to an off-line other finishing or processing device. The translating member is then able to quickly return to the compiling position so as to not impair the process speed of the printing machine. In a second mode a multitude of sheet sets are first compiled and then delivered to an operator.

12 Claims, 5 Drawing Sheets

COMPILED SET TRANSFER DEVICE

This invention relates generally to an electrophotographic printing machine, and more particularly concerns an apparatus for delivering individual sets of compiled sheets to an off-line finishing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high-speed commercial printing machine of the foregoing type, large volumes of unfinished sets of copy sheets are fed onto a stacking tray. Typically, when the tray is loaded to its capacity, an elevator moves the tray to a station where the operator can readily remove the finished or unfinished sets of copy sheets. Hereinbefore, the sets of copy sheets have always been delivered either to a machine operator or to a finishing machine at the end of each job. It is desirable to have a device that will deliver each individual compiled set to an off-line finishing device such as a signature booklet maker or some other binding or attaching device. To accomplish such delivery, the delivery device must be able to operate at process speed so as to not inhibit the function of the printing machine.

The following disclosures may be relevant to various aspects of the present invention:

- U.S. Pat. No. 5,018,717 to Sadwick, et ano, issued on May 28, 1991
- U.S. Pat. No. 4,926,220 to Matysek, et ano, issued on May 15, 1990
- U.S. Pat. No. 4,871,158 to May, et al., issued on Oct. 3, 1989
- U.S. Pat. No. 4,586,640 to Smith issued on May 6, 1986
- U.S. Pat. No. 4,444,491 to Rinehart, et al. issued on Apr. 24, 1984
- U.S. Pat. No. 4,417,801 to Elsemann, issued on Nov. 29, 1983
- U.S. Pat. No. 4,358,197 to Kukucka issued on Nov. 9, 1982

The relevant portions of the foregoing disclosures may be briefly summarized as follows:

U.S. Pat. No. 5,018,717 discloses an apparatus in which an elevator movably supports a drawer having a tray associated therewith. The tray receives successive sheets at a loading station and the elevator moves continuously downward to maintain the uppermost sheet of the stack of sheets on the tray at a preselected location in the loading station until the drawer and tray are positioned at a discharge station located inside of a housing. The sheets are then transferred to an unloading station external of the housing.

U.S. Pat. No. 4,926,220 discloses a dual-mode apparatus in which sets of sheets are delivered to an operator in response to a selected mode of operation. Sets of sheets are advanced from the loading station to the unloading station for delivery to the operator. In one mode of operation, the sets are advanced from the loading station to the unloading station after the completion of each job and in another mode of operation, the sets of sheets are advanced from the loading station to the unloading station after the maximum number of sets of sheets have been stacked at the loading station independent of the number of jobs.

U.S. Pat. No. 4,871,158 discloses a copying finisher system having a compiling station for receiving a collated copy set prior to stapling. The station is defined by reciprocally movable horizontally arranged collecting plate upon which the copy sheets are collected. The arrangement presents the leading edge of the sheets to the clamping position of one or more staplers. After collection of the copy sheets, the leading edge of the set is clamped and stapled while the plate is moved to permit dropping of the finished set.

U.S. Pat. No. 4,586,640 describes an apparatus in which a plurality of sheets are attached to one another to form a booklet thereof. Sheets are compiled to form a set which is then advanced to a stapling apparatus and/or a binding apparatus.

U.S. Pat. No. 4,444,491 discloses a very high speed fully automated reproduction system having a post,collation device for the arrangement of copy sheets into copy sets. A sorter :bin array having a number of bins equal to a predetermined number of sets is arranged to collate the resulting copy sheets in the corresponding copy sets. The copy sets are then removed from the bin array for stapling and/or stacking and non-stapling.

U.S. Pat. No. 4,417,801 discloses a copy sheet registration arrangement for a copier finisher system. Sheets are transported to a compiler station for the finisher and are subject to a two-step registration process.

U.S. Pat. No. 4,358,197 discloses a copy set collecting and storage arrangement for a high speed reproduction system having a finishing station. The arrangement includes an elevator for collecting finished copy sets in a stack and a conveyor for receiving one or more stacks from the elevator.

In accordance with one aspect of the present invention, there is provided an apparatus for ejecting compiled sets of sheets to an operator or a finishing device. The apparatus comprises an operator controllable mode selector and a base member adapted to receive and support sheet sets. Means, responsive to said mode selector, are provided for transporting the compiled sets of sheets. The transporting means being mounted on the base member so that the transporting means supports a sheet set after the set is received at said base member. The transporting means is moveable relative to said base member in a direction transverse to the sheet path. The transporting means, in a first mode moves each set of sheets individually as each set is received on the transporting means so that the lead edge of the compiled set of sheets is delivered to substantially the same location each time a set is transported. The set of sheets is transported to the finishing device. In a second mode, the transporting means remains stationary with respect to the base member so that a plurality of sheet sets of a job are compiled on the base member for removal by the operator.

Pursuant to another aspect of the present invention, there is provided an electrophotographic printing machine having a finishing device including an apparatus for ejecting compiled sets of sheets to an operator or an off line finishing device. The ejecting device comprises an operator controllable mode selector and a base member adapted to receive and support sheet sets. Means, responsive to the mode selector, are provided for transporting the compiled sets of sheets. The transporting means is mounted on the base member so that the transporting means supports a sheet set after the set is received at the base member. The transporting means is moveable relative to the base member in a direction transverse to the sheet path. The transporting means, in a first mode moves each set of sheets of a job individually as each set is received on the transport means. The lead edge of the compiled set of sheets is delivered to substantially the same location each time a set is transported. The set of sheets is transported from a location internal to the printing machine to a location external of the printing machine. The transporting means is adapted to operate in the first mode at a speed substantially equal to the printing machine process speed for delivery to the off line finishing device. In a second mode, the transporting means remains stationary with respect to the base member so that a plurality of sheet sets of a job are compiled on the base member for removal by the operator.

Other features of the present invention will become apparent as the following description proceeds and upon reference to the drawings, in which.

Figure 4:
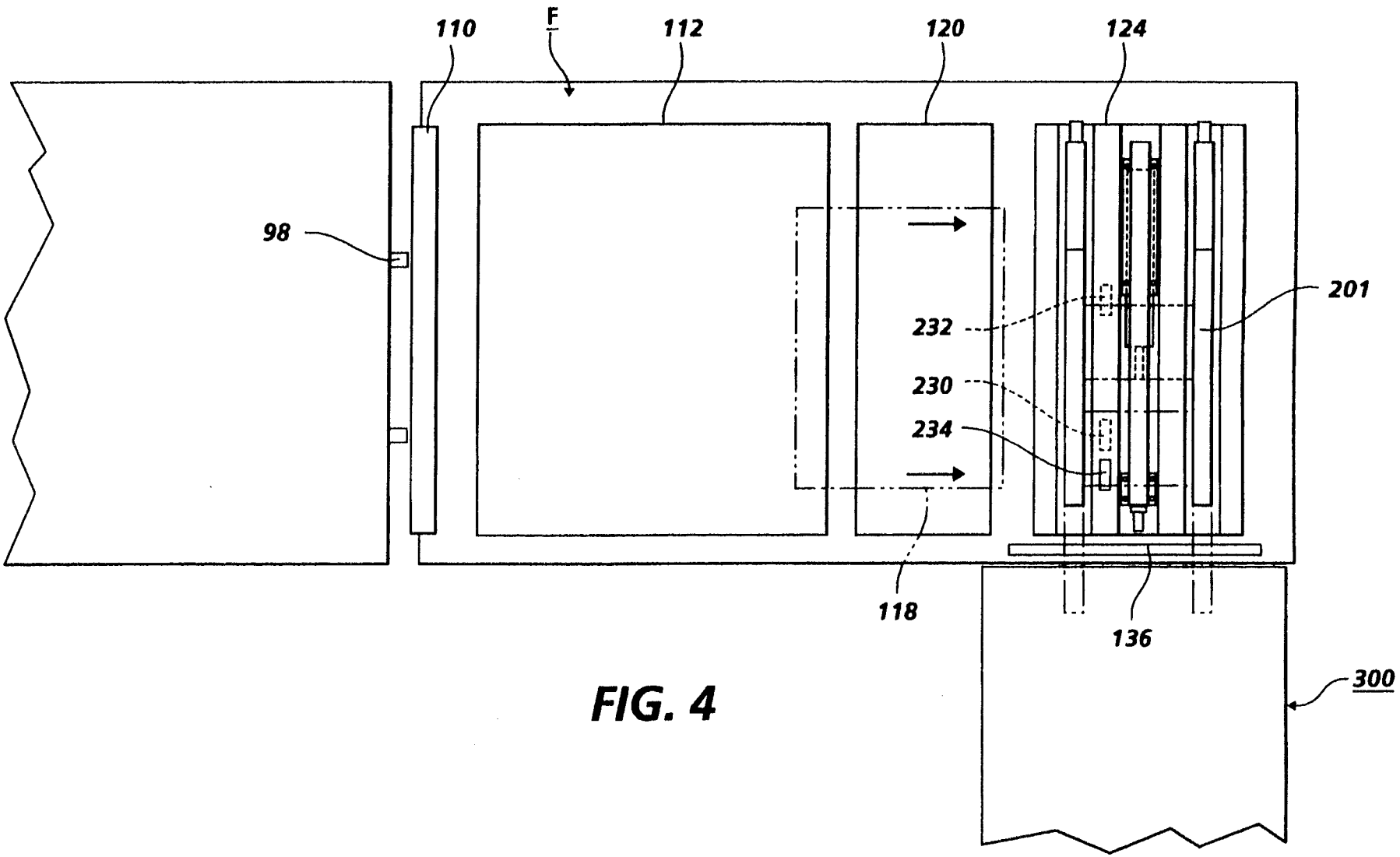
Figure 5:
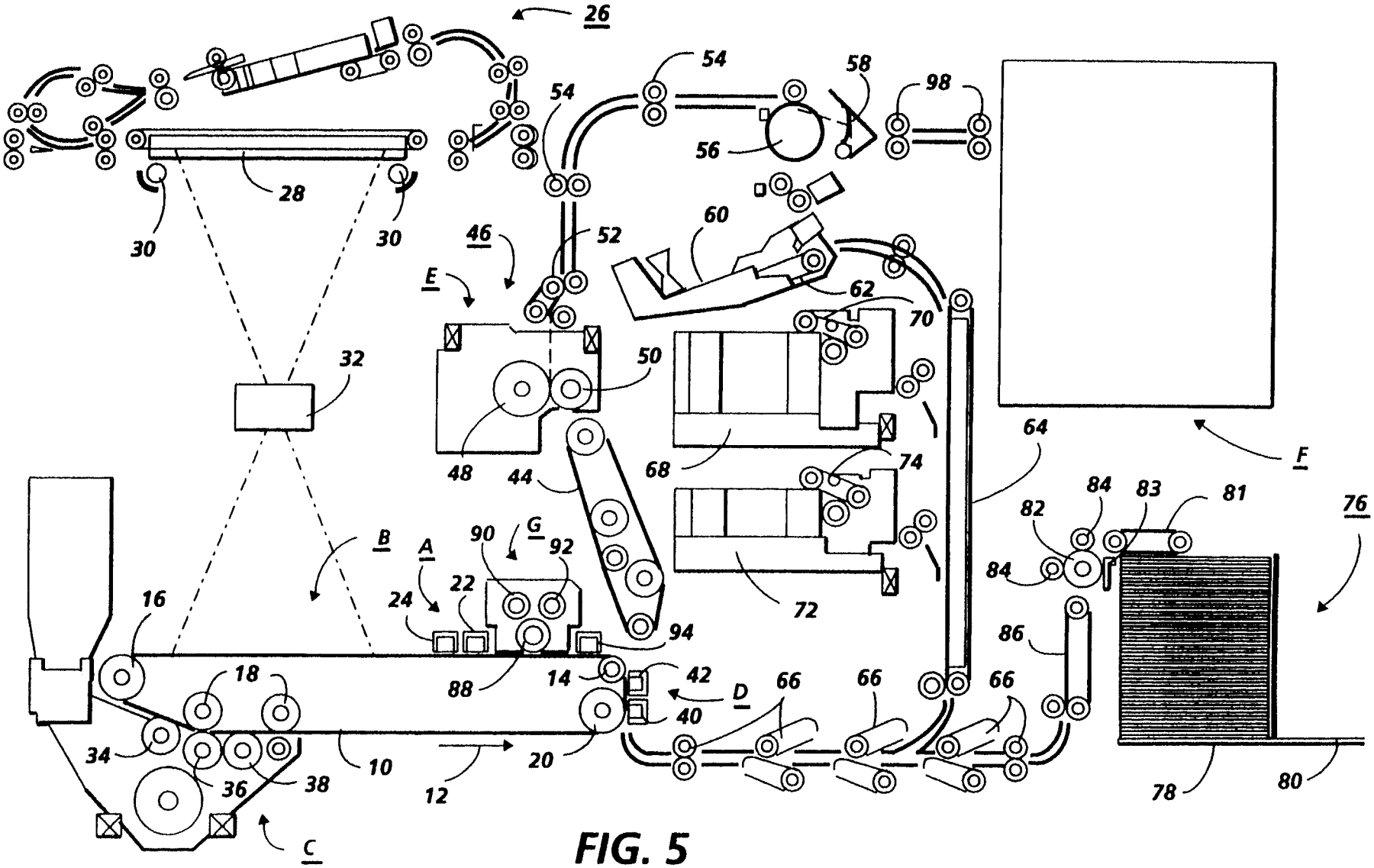

FIG. 4 is a schematic plan view depicting the output section of an illustrative electrophotographic printing machine incorporating a finisher having the compiled set transfer device of the present invention; and FIG. 5 is a schematic elevational view depicting an illustrative electrophotographic printing machine incorporating a finisher having the compiled set transfer device of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 5 schematically depicts an electrophotographic printing machine incorporating the features of the present invention therein. It will become evident from the following discussion that the set transfer device of the present invention may be employed in a wide variety of machines and is not specifically limited in its application to the particular embodiment depicted herein.

Referring to FIG. 5 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar TM (a polyethyleneterephthalate film made by DuPont). The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit indicated generally by the reference numeral 26 is positioned over platen 28 of the printing machine. Document handling unit 26 sequentially feeds documents from a stack of documents placed by the operator faceup in a normal forward collated order in the document stacking and holding tray. A document feeder located below the tray, forwards the bottom document in :the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of the document is achieved by lamps 30 which illuminate the document on a platen 28. Light rays reflected from the document are transmitted through the lens 32. Lens 32 focuses light images of the document onto the charged portion of the photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS. Other types of imaging systems may also be used employing, for example, a pivoting or shiftable LED write bar or projection LCD (liquid crystal display) or other electro-optic display as the "write" source.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pretransfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in,; one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets can be attached to one another by either: a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on:, which an image will be subsequently printed on the second, opposite side thereof, i.e., the sheets being duplexed. The sheets are stacked in duplex tray 60 face-down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. The high capacity sheet feeder, indicated generally by the reference numeral 76, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of clearing station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected.

In the preferred embodiment, the set ejector device is used together in a finishing device such as that which is described in U.S. Pat. No. 5,018,717 to Sadwick et ano., which patent is commonly assigned to the assignee of the invention herein, the relevant portions of which are herein incorporated by reference.

Figure 1:
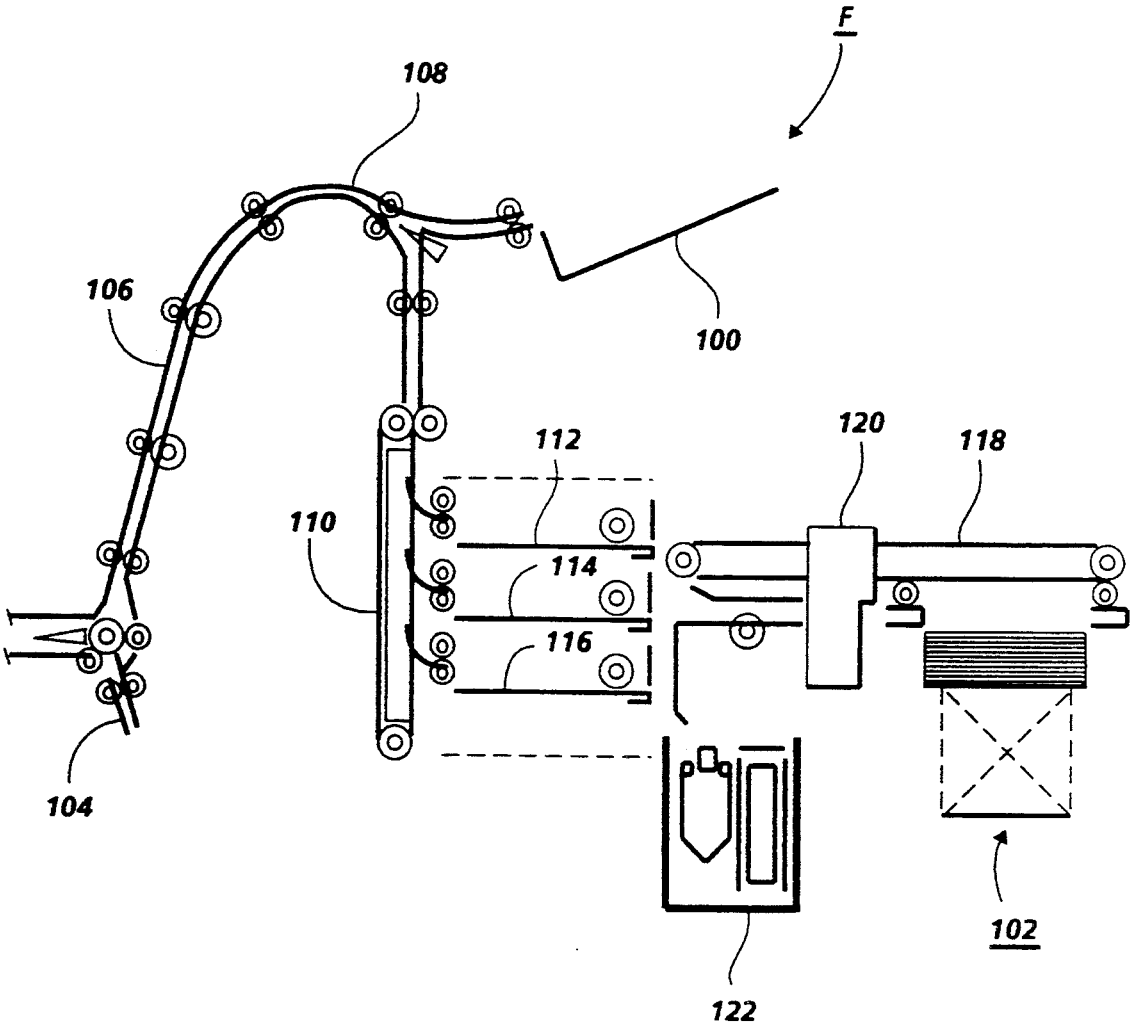
FIG. 1 is a schematic view of the finishing station of an electrophotographic printer.

Turning now to FIG. 1, the general operation of finishing station F will now be described. Finishing station I: receives fused copies from rolls 98 (FIG. 5) and delivers them to the top tray 100 or the sheet stacking and delivering apparatus, indicated generally by the reference numeral 102. The details of the sheet stacking apparatus 102, which includes the set transfer device of the present invention, will hereinafter be described with reference to FIGS. 2, 3, and 4. Sets of copy sheets delivered to the sheet stacking apparatus 102 may be either collated or uncollated and finished or unfinished. Finishing station F can also bind sets and deliver stacks of or individual bound sets to stacking apparatus 102. When unfinished sheet sets are to be delivered to the set ejection apparatus of the present invention, they are transported from the output transport 108 to the vacuum transport 110. Vacuum transport 110 is used to transport sheets from transport 108 to bins 112, 114 or 116. Bins 112, 114, and 116 are used to compile and register sheets into sets. The bins are driven up or down by a bi-directional AC bin drive motor adapted to position the proper bin at the unloading position. A set transport 118 has a pair or set clamps mounted on two air cylinders and driven by four air valve solenoids. Two of the air valves are used for positioning the set transport and two are used for the retract function. Set transport 118 is used to transport sets from the bins to the internal stitcher 120, binder 122 or the sheet stacking and set ejector apparatus 102.

Figure 2:
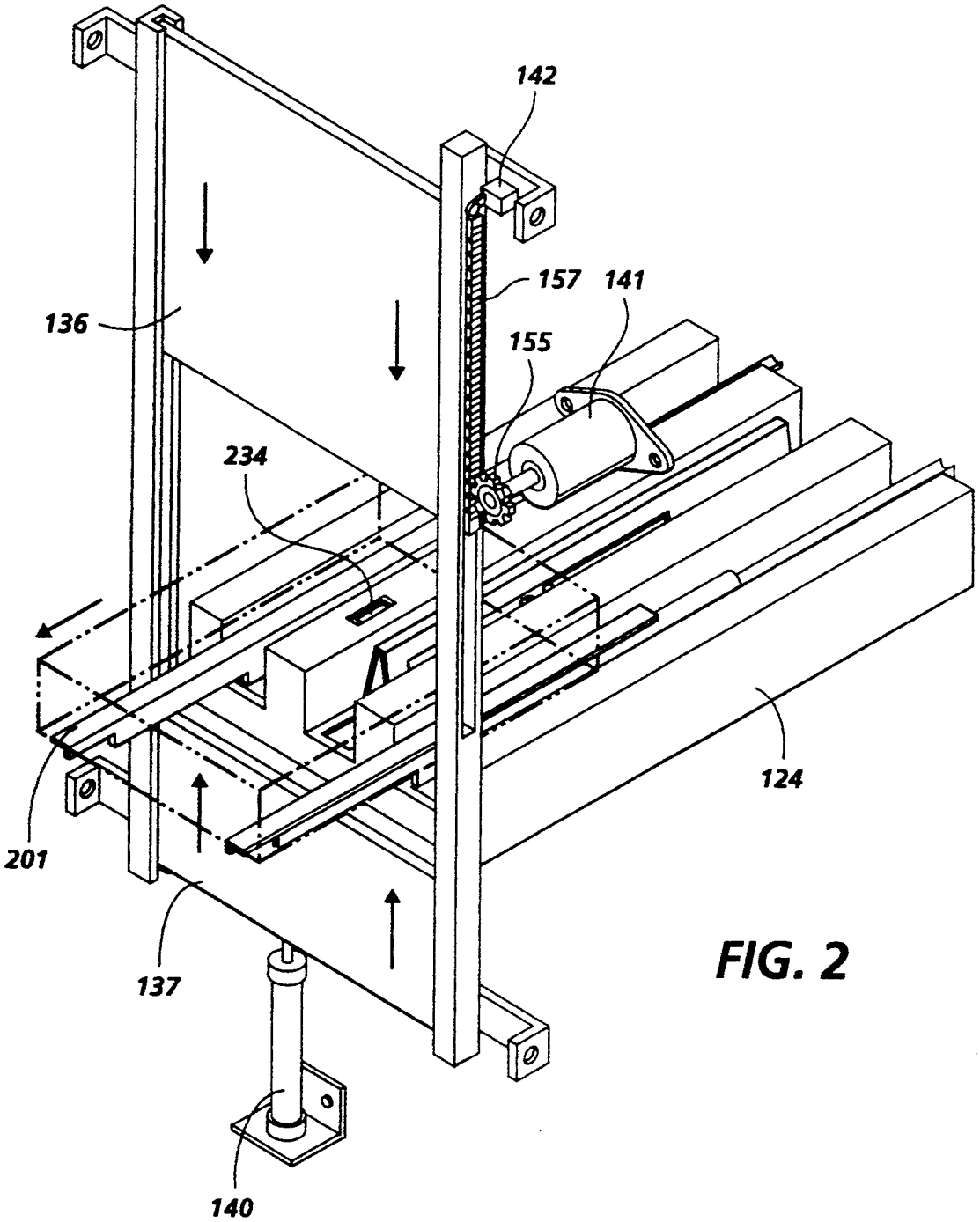
FIG. 2 is a perspective view of the discharge elevator of the delivery portion of the finishing station of FIG. 1.

FIG. 2 is a perspective view of the elevator doors 136, 137 showing the operation thereof and further illustrating the slideable support rack 201 of the set ejector mechanism 200 of the present invention partially extended out of the doors. When the individual set ejector mechanism of the present invention is not selected, the elevator delivers a stack of compiled sets to the operator. The door 136 is mounted vertically slideably in the cover the finishing station of the printing machine. Both the loading station and the discharge station are located internally of the finishing station of the printing machine. The intermediate station and the unloading station are positioned externally of the finishing station of the printing machine. As sets of sheets are advanced onto the tray 126 a stack height sensor causes the entire tray and drawer assembly to be lowered by an elevator (not shown) from the highest position to a lower position to accommodate the stack of sheet sets that is accumulated thereon. The slideable support rack 201 and the fixed support 208 (FIG. 3) of the set ejector mechanism constitute the sheet support portion of tray 126. Once the job run is complete or the tray and drawer are loaded to capacity the stack of compiled sets is unloaded as follows. The tray and drawer are lowered to the unload position. The upper surface of tray 126 is descended below the upper surface of the drawer 124. Motor 141 is energized to rotate the gear 155. Gear 155 meshes with rack 157. Rack 157 is mounted on upper door portion 136. As the motor 141 rotates the gear 155, rack 157 translates upwardly or downwardly, moving the upper door 136 therewith. When the upper door 136 reaches its highest point a valve 142 is activated which causes a lower door 137 to be retracted downward by pneumatic cylinder 140. In this way, doors 136, 137 open enabling the sets of copy sheets transferred from tray 126 to drawer 124 to move therewith from the discharge station to the intermediate station and then to the unloading station where the operator removes the sets of copy sheets therefrom. When the individual set ejector mechanism is selected, however, the operation is somewhat different.

Figure 3:
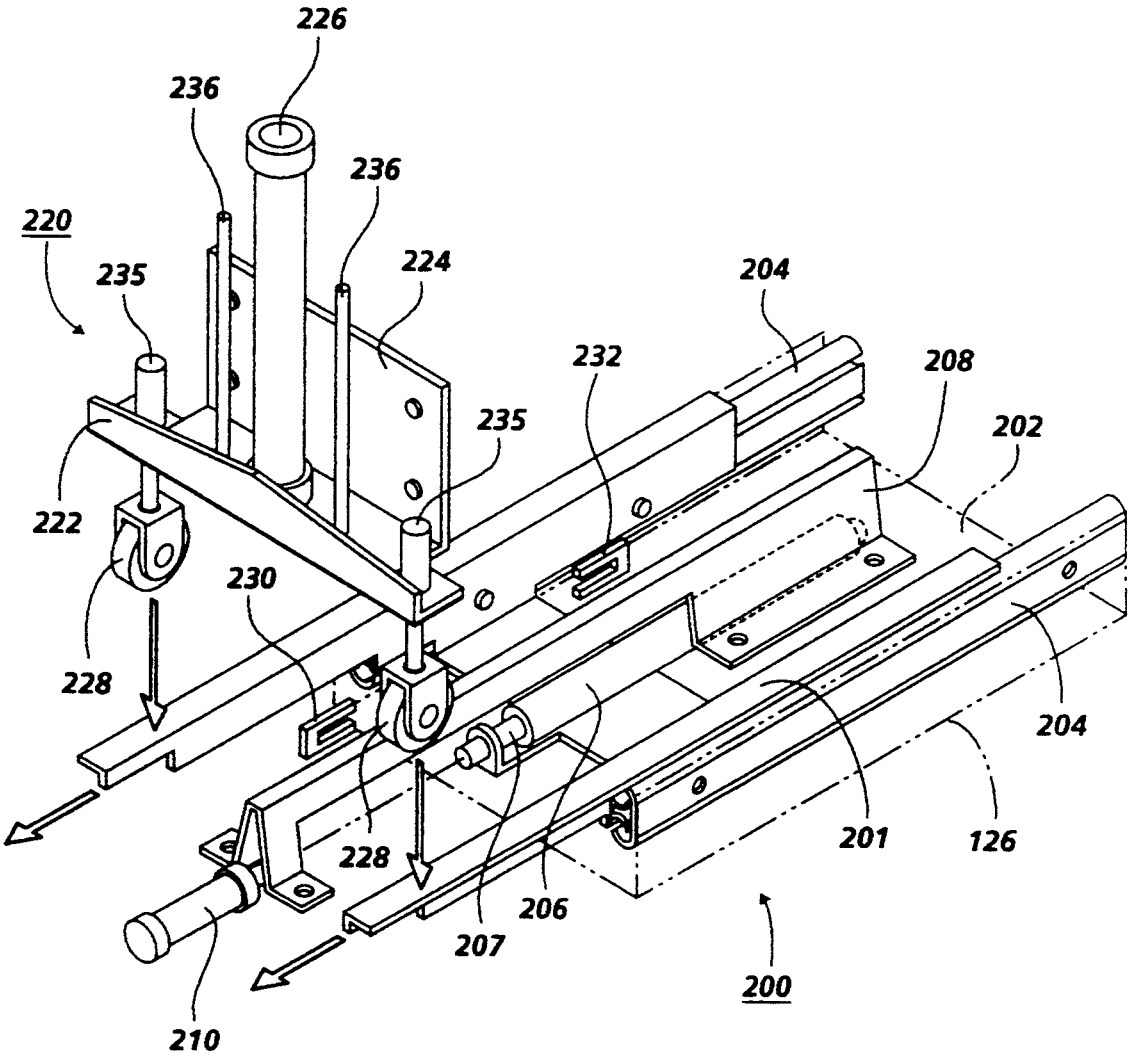
FIG. 3 is a perspective view of the compiled set transfer device of the present invention.

FIG. 3 is a perspective view of the individual set ejector mechanism 200 of the present invention. The individual set ejector mechanism 200 consists of a slideable support rack 201 mounted to a base frame 202. The support rack 201 is moveable with respect to the base 202 by way of slides 204. A pneumatic cylinder 206 attached at one end to the base 202 which is a part of tray 126 and at the other end to the support rack 201 is actuated to cause the support rack 201 to move along on slides 204 with respect to the base 202. A hydraulic damper 210 is provided at the end of the base 202 to dampen the motion of and slowly decelerate the support rack 201. This damping motion helps to prevent unattached sheets in the sets from being misaligned with each other and thus maintains the integrity of the stack. A bail unit 220 provides a normal force upon a set of sheets to further prevent the Sheet set from becoming skewed or misaligned during the transport. The bail unit 220 consists of a moveable frame 222 which supports a pair of rollers 228 mounted in shock absorbing type mounts 235. These mounts 235 contain biasing elements, such as springs or other known flexible members which allow the rollers to compensate in the event that the moveable frame 222 does not lower in a perfectly horizontal alignment. The moveable frame 222 is connected to a mounting bracket 224 by means of a pneumatic cylinder 226. There is also provided a pair of guide rods 236 which keep the moveable frame 222 in a substantially horizontal position as it is moved up and down vertically.

The relationship between the set ejector mechanism 200 and the other components of finishing station F is illustrated in FIG. 4. In operation, sheets are discharged from the electrophotographic printing machine, compiled into sets, transported to the set ejector/elevator and individually ejected to an off-line finishing device 300.

The sheets are first discharged through discharge rollers 98 to sheet transport 110. The sheets are then compiled into a set in one of the compiling bins 112, 114, 116. A set of compiled sheets is transported by transport 118 to the set ejector mechanism 200, which is made up in part of the slideable support rack 201 and the fixed rail portion 208 (FIG. 3) of the tray 126. The elevating tray 126 and drawer 124 (FIG. 2) are in the raised position and do not lower as when multiple sets are compiled as described above with reference to FIG. 2. The moveable frame 222 which has the rollers 228 is then lowered so that the rollers 228 apply a normal force to the compiled sheet set to maintain the set registration. The doors 136, 137 are opened in the same manner as described above. The pneumatic cylinder 206 is then actuated to cause the sheet set to be moved along with the support rack 201 in a direction transverse to the paper path to deliver the sheet set through the door opening to the front of the finishing apparatus as illustrated in FIG. 2. The moveable piston 207 of the pneumatic cylinder 206 is aligned so that at the end of the stroke of the cylinder 206 the piston 207 contacts the hydraulic damper 210. This prevents the support rack 201 from jarring to a halt which could possibly disturb the unattached compiled sheet set. It should be noted that a set which is discharged by use of the individual set ejector mechanism 200, regardless of sheet size, is always presented with the lead edge of the sheet stack at substantially the same position for input into a off-line finishing device 300 or some other sheet finishing apparatus or for removal by an operator.

The ejector mechanism 200 is capable of operating at a speed sufficient so that the production of the printing machine and the finishing apparatus 300 is not impaired. To assure that the mechanism is operating properly a sensor 230 is positioned to determine when the support rack is in the fully extended position and a second sensor 232 is positioned to determine when the support rack is in the fully withdrawn position. A third sensor 234 is utilized to assure that the sheet set is removed from the support rack before another set is :delivered. In an operative cycle, when the set is delivered to the support rack an internal clock in the machine controller is started. A signal must then be received from the fully extended sensor 230 within a preprogrammed time frame or a fault signal is generated. Once the fully extended signal is received, a second clock count is begun. This count is then monitored until a signal is received from the fully retracted sensor 232. Again, if the signal is not received within a certain preprogrammed parameter an error signal is generated. Once the fully retracted signal is received the tray empty sensor 234 must indicate that the support rack is indeed empty before another set will be delivered to the support rack. This timing scheme allows the output of a high speed printing machine to be throughput to an auxiliary finishing device 300 such as a signature booklet maker without a loss in productivity.

The individual set ejector mechanism 200 can also be used to eject individual bound or stitched sets into a cover inserter or some other sheet set processing device such as a shrink wrap machine. Thus, the individual set ejector mechanism is:able to be utilized with both compiled, unattached sheet sets and bound or otherwise attached individual sets of sheets.

In recapitulation, there is provided an individual sheet set ejector mechanism which is capable of operating at machine process speed and delivers individual attached or unattached sets of sheets to a location external of the electrophotographic printing machine for further processing. As a result of the configuration of the set ejector mechanism, the lead edge of the compiled sheet set is always delivered to substantially the same location independent of the sheet size. This allows a wide variety of off-line finishing or processing machines to be utilized in conjunction with the ejector mechanism.

It is, therefore, apparent that there has been provided in accordance with the present invention, an individual set ejector mechanism that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for ejecting compiled sets of sheets to an operator or a finishing device, comprising:

an operator controllable mode selector;

a base member adapted ;to receive and support sheet sets, said base member being vertically movable from a first position to a second position;

means, responsive to said mode selector, for transporting the compiled sets of sheets, said transporting means being mounted on said base member so that said transporting means supports a sheet set after the set is received at said base member, said transporting means being movable relative to said base member in a direction transverse to a sheet path, said transporting means, in a first mode, moving each set of sheets individually as each set is received on said transport means when said base member is located at the first position so that a lead edge of the compiled set of sheets is delivered to substantially a same location each time a set is transported, with the set of sheets being transported to the finishing device, and, in a second mode, said transporting means remaining stationary with respect to said base member so that a plurality of sheet sets of a job are compiled on said base member for removal by an operator when said base member is located at the second position.

2. An apparatus according to claim 1, including means for monitoring said transporting means so that the finishing device operational speed is not impaired.

3. An apparatus according to claim 2, wherein said transporting means comprises:

a transfer adapted to support the compiled sets of sheets;

means for translating said sheet set support transfer member from a sheet receiving position to a sheet unloading position for delivery to the finishing device; and means for maintaining integrity of the sheet set.

4. The apparatus according to claim 2, wherein said monitoring means comprises:

a first sensor adapted to generate a signal responsive to said transporting means being in a fully extended position to transfer the set of sheets to the finishing device;

a second sensor adapted to generate a signal in response to said transporting means being in a fully retracted position so as to receive the set of sheets;

a third sensor adapted to generate a signal indicative of the set of sheets being positioned on the transporting means; and means for determining if the signals from said first sensor, said second sensor and said third sensor are generated within a preselected time, and generating a signal indicative thereof.

5. An apparatus for electing compiled sets of sheets to an operator or a finishing device, comprising:

an operator controllable mode selector;

a base member adapted to receive and support sheet sets;

means, responsive to said mode selector, for transporting the compiled sets of sheets, said transporting means being mounted on said base member so that said transporting means supports a sheet set after the set is received at said base member, said transporting means being movable relative to said base member in a direction transverse to a sheet path, said. transporting means, in a first mode, moving each set of sheets individually as each set is received on said transport means so that a lead edge of the compiled set of sheets is delivered to substantially a same location each time a set is transported, with the set of sheets being transported to the finishing device, and, in a second mode, said transporting means remaining stationary with respect to said base member so that a plurality of sheet sets of a job are compiled on said base member for removal by an operator, said transporting means comprising a transfer member adapted to support the compiled sets of sheets, means for translating said sheet set support transfer member from a sheet receiving position to a sheet unloading position for delivery to the finishing device and means for maintaining integrity of the sheet set, said translating means comprises a base, a pneumatic cylinder attached at a first end to said base, a movable piston attached to said sheet support transfer member, operatively associated with said cylinder so that actuation of the cylinder causes the sheet support transfer member to be moved from the receiving position to the unloading position; and means for monitoring said transporting means so that the finishing device operational speed is not impaired.

6. An apparatus for ejecting compiled sets of sheets to an operator or a finishing device, comprising:

an operator controllable mode selector;

a base member adapted to receive and support sheet sets;.

means, responsive to said mode selector, for transporting the compiled sets of sheets, said transporting means being mounted on said base member so that said transporting means supports a sheet set after the set is received at said base member, said transporting means being movable relative to said base member in a direction transverse to a sheet path, said transporting means, in a first mode, moving each set of sheets individually as each set is received on said transport means so that a lead edge of the compiled set of sheets is delivered to substantially a same location each time a set is transported, with the let of sheets being transported to the finishing device, and, in a second mode, said transporting means remaining stationary with respect to said base member so that a plurality of sheet sets of a job are compiled on said base member for removal by an operator, said transporting means comprising a transfer member adapted to support the compiled, sets of sheets, means for translating said sheet set support transfer member from a sheet receiving position to a sheet unloading position for delivery to the finishing device and means for maintaining integrity of the sheet set, said maintaining means comprises a bracket, a pneumatic cylinder including a main body and a movable piston located within said main body, said main body being attached to said bracket and a sheet contacting member attached to said piston of said pneumatic cylinder, said sheet contacting member moving in a vertical direction and applying a normal force to the set of sheets; and means for monitoring Said transporting means so that the finishing device operational speed is not impaired.

7. An electrophotographic printing machine having a finishing device including an apparatus for ejecting individual compiled sets of sheets to an off line finishing device having further finishing capabilities, comprising:

an operator controllable mode selector;

a base member adapted to receive and support sheet sets, said base member being vertically movable from a first position to a second position; and means, responsive to said mode selector, for transporting the compiled sets of sheets, said transporting means being mounted on said base member so that said transporting means supports a sheet set after the set is received at said base member, said transporting means being movable relative to said base member in a direction transverse to a sheet path, said transporting means, in a first mode, moving each set of sheets individually as each set is received on said transport means when said base member is located at the first position so that a lead edge of the compiled set of sheets is delivered to substantially a same location each time a set is transported, the set of sheets being transported from a location internal to the printing machine to the finishing device, said transporting means being adapted to operate in the first mode at a speed substantially equal to the printing machine process speed for delivery to the off line finishing device, and, in a second mode, said transporting means remaining stationary with respect to said base member so that a plurality of sheet sets of a job are compiled on said base member for removal by an operator when said base member is located at the second position.

8. A printing machine according to claim 7, including means for monitoring said transporting means so that the finishing device operational speed is not impaired.

9. A printing machine according to claim 8, wherein said transporting means comprises:

a transfer member adapted to support the compiled sets of sheets;

means for translating said sheet support transfer member from a sheet receiving position to a sheet unloading position for delivery to the finishing device; and means for maintaining integrity of the sheet set.

10. A printing machine according to claim 8, wherein said monitoring means comprises:

a first sensor adapted to generate a signal responsive to said transporting means being in a fully extended position to transfer the set of sheets to the finishing device;

a second sensor adapted to generate a signal in response to said transporting means being in a fully retracted position so as to receive the set of sheets;

a third sensor adapted to generate a signal indicative of the set of sheets being positioned on the transporting means; and means for determining if the signals from said first sensor, said second sensor and said third sensor are generated within a preselected time, and generating a signal indicative thereof.

11. An electraphotographic printing machine having a finishing device including an apparatus for ejecting individual compiled sets of sheets to an off line finishing device having further finishing capabilities, comprising:

an operator controllable mode selector;

a base member adapted to receive and support sheet sets;

means, responsive to said mode selector, for transporting the compiled sets of sheets, said transporting means being mounted on said base member so that said transporting means supports a sheet set after the set is received at said base member, said transporting means being movable relative to said base member in a direction transverse to a sheet path, said transporting means, in a first mode, moving each set of sheets individually as each set is received on said transport means so that a lead edge of the compiled set of sheets is delivered to substantially a same location each time a set is transported, with the set of sheets being transported to the finishing device, and, in a second mode, said transporting means remaining stationary with respect to said base member so that a plurality of sheet sets of a job are compiled on said base member for removal by an operator, said transporting means comprising a transfer member adapted to support the compiled sets of sheets, means for translating said sheet set support transfer member from a sheet receiving position to a sheet :unloading position for delivery to the finishing device and means for maintaining integrity of the sheet set, said translating means comprises a base, a pneumatic cylinder attached at a first end to said base, a movable piston attached to said sheet support transfer member, operatively associated with said cylinder so that actuation of the cylinder causes the sheet support transfer member to be moved from the receiving position to the unloading position; and means for monitoring said transporting means so that the finishing device operational speed is not impaired.

12. An electrophotographic printing machine having a finishing device including an apparatus for ejecting individual compiled sets of sheets to an off line finishing device having further finishing capabilities, comprising:

an operator controllable mode selector;

a base member adapted to receive and support sheet sets;

means, responsive to said mode selector, for transporting the compiled sets of sheets, said transporting means being mounted on said base member so that said transporting means supports a sheet set after the set is received at said base member, said transporting means being movable relative to said base member in a direction transverse to a sheet path, said transporting means, in a first mode, moving each set of sheets individually as each set is received on said transport means so that a lead edge of the compiled set of sheets is delivered to substantially a same location each time a set is transported, With the set of sheets being transported to the finishing device, and, in a second mode, said transporting means remaining stationary with respect to said base member so that a plurality of sheet sets of a job are compiled on said base member for removal by an operator, said transporting means comprising a transfer member adapted to support the compiled sets of sheets, means for translating said sheet set support transfer member from a sheet receiving position to a sheet, unloading position for delivery to the finishing device and means for maintaining integrity of the sheet set, said maintaining means comprises a bracket a pneumatic cylinder including a main body and a movable piston located within said main body, said main body being attached to said bracket and a sheet contacting member attached to said piston of said pneumatic cylinder, said sheet contacting member moving in a vertical direction and applying a normal force to the set of sheets; and means for monitoring said transporting means so that the finishing device operational speed is not impaired.

* * * * *